US007384030B2

(12) United States Patent
Nagai

(10) Patent No.: US 7,384,030 B2
(45) Date of Patent: Jun. 10, 2008

(54) METHOD FOR PRODUCING A PRINT ARTICLE COMPRISING A PROTECTIVE SIGNATURE ATTACHED TO INSIDE FOLDED EDGE OF A PRINTED PRODUCT

(75) Inventor: Teruaki Nagai, Tokyo (JP)

(73) Assignee: Muller Martini Nolding AG, Hergiswil (CH)

( * ) Notice: Subject to any disclaimer, the term of this patent is extended or adjusted under 35 U.S.C. 154(b) by 0 days.

(21) Appl. No.: 10/817,434

(22) Filed: Apr. 5, 2004

(65) Prior Publication Data

US 2004/0239026 A1 Dec. 2, 2004

(30) Foreign Application Priority Data

Apr. 4, 2003 (EP) ..... 03405228

(51) Int. Cl.
*B65H 37/04* (2006.01)

(52) U.S. Cl. ..... 270/52.18; 270/58.07; 270/58.08

(58) Field of Classification Search ..... 270/52.18, 270/58.07, 58.08; 412/4, 8, 19, 37, 901
See application file for complete search history.

(56) References Cited

U.S. PATENT DOCUMENTS 4,207,984 A 6/1980 Kelly et al.
4,420,282 A * 12/1983 Axelrod ..... 412/4
4,556,353 A * 12/1985 Ehlermann ..... 412/5
5,028,193 A 7/1991 Misicka
5,261,769 A * 11/1993 Leclerc ..... 412/4
5,678,813 A * 10/1997 Osako et al. ..... 270/52.16
6,328,519 B1 * 12/2001 Nagai ..... 412/8
6,612,559 B2 * 9/2003 Boss ..... 270/52.18

FOREIGN PATENT DOCUMENTS

EP 1 147 917 A2 10/2001

OTHER PUBLICATIONS

Patent Abstracts of Japan, vol. 1997, No. 8, Aug. 29, 1997 & JP 09 095065 A (Dainippon Printing Co., Ltd.), Apr. 8, 1997.
Patent Abstracts of Japan, vol. 1997, No. 7, Jul. 31, 1997 & JP 09 086069 A (Dainippon Printing Co. Ltd.), Mar. 31, 1997.

* cited by examiner

*Primary Examiner*—Gene O. Crawford
*Assistant Examiner*—Leslie A Nicholson, III
(74) *Attorney, Agent, or Firm*—Venable LLP; Robert Kinberg; Catherine M. Voorhees

(57) ABSTRACT

A method and apparatus are provided for producing a print article including at least one printed product having inside and outside folded edges. The printed products are transported on a saddle-shaped conveying section of a conveying track, with the printed product straddling the conveying section. The printed product is wire-stitched along the outside folded edge thereof so that pre-formed wire sections point toward the inside folded edge. The outside folded edge of a protective signature is glued to the inside folded edge of the printed product to form a combined article.

6 Claims, 1 Drawing Sheet

METHOD FOR PRODUCING A PRINT ARTICLE COMPRISING A PROTECTIVE SIGNATURE ATTACHED TO INSIDE FOLDED EDGE OF A PRINTED PRODUCT

CROSS-REFERENCE TO RELATED APPLICATION

This application claims the priority of European Patent Application with Serial No. 03405228.2-2304, filed on Apr. 4, 2003, the subject matter of which is incorporated herein by reference.

BACKGROUND OF THE INVENTION

The invention relates to a method for producing a print article, including at least one printed product or signature that is wire-stitched along an outside folded edge with pre-formed wire sections or staples pointing toward an inside folded edge of the printed product. The printed product is transported straddling a saddle-type conveying section along a conveying track and is subsequently stitched.

This type of operation is designed in particular to protect human body parts against injury caused by wire staples.

U.S. Pat. No. 5,678,813A discloses a method for producing print articles from printed products in which the wire staples are inserted from the inside folded edge pointing toward the outside. The wire staple closures that project along the outside folded edge are covered by a cover sheet with an adhesive.

The patent also discloses an alternative sequence of the method steps in which the printed product that is wire-stapled from the outside toward the inside is combined with a printed product that is stapled from the inside toward the outside by gluing these together along the folds, thus hiding the staple closures.

Even though the cover sheet, glued to the outside folded edge of a printed product that is stitched from the inside toward the outside, provides a protective function against injury, it is stressed during use to such a degree that it will separate from the outside folded edge after a certain amount of time and thus lose its protective effect.

SUMMARY OF THE INVENTION

It is an object of the present invention to create a print article which is wire-stitched from the outside folded edge toward the inside folded edge to provide a compact wire-stitching and wherein the wire closures are covered with a protective signature.

The above and other objects are achieved wherein, according to an exemplary embodiment of the invention, there is provided a method for producing a print article including at least one printed product having inside and outside folded edges, the method comprising the steps of: transporting the printed product on a saddle-shaped conveying section of a conveying track, the printed product straddling said conveying section; wire-stitching the printed product along the outside folded edge thereof so that pre-formed wire sections point toward the inside folded edge; and gluing the outside folded edge of a protective signature to the inside folded edge of the printed product to form a combined article.

Thus, according to the invention, the aforementioned problem is solved by gluing together the inside folded edge of the wire-stitched printed product and the outside folded edge of a protective signature, thus preventing injury.

It is advantageous if the printed product and the protective signature are combined on a second conveying section of a conveying track, thus resulting in a continuous process in where the printed product and the protective signature are joined with synchronous timing.

It has proven advantageous if an adhesive is applied to the outside folded edge of the protective signature while on its way to the joining location. For example, the conveying movement of the protective signature may be used for applying the adhesive.

As an alternative, adhesive can also be applied to the inside folded edge of the wire-stitched printed product while on its way to be combined with the protective signature.

Of course, a cover sheet can also be supplied to the outside folded edge of the combined article (i.e., the printed product combined with the protective signature) on an additional conveying section of the conveying track, wherein the cover sheet can be attached by gluing it, for example, to the outside folded edge of the combined article.

To combine the protective signature with the printed product from the first conveying section of the conveying track, the printed product is preferably transported in an open state or is re-opened during the transport, so that it can be precisely positioned without friction on the protective signature.

According to a further aspect of the invention there is provided an apparatus for producing a print article formed with at least one printed product that is wire-stitched along the outside folded edge. According to an exemplary embodiment, the apparatus comprises a first conveying section of a conveying track having a saddle-shaped support for conveying the printed product, the printed product straddling the saddle-shaped support and a wire-stitching section for wire-stitching the printed product; a second conveying section of the conveying track having a saddle-shaped support conveying a protective signature; and a circulating intermediate conveyor positioned near the end of the first conveying section and in alignment with the second conveying section, the intermediate conveyor picking up the printed product from the first conveying section and transporting and depositing the printed product in an opened state onto a protective signature conveyed by the second conveying section.

It is advantageous if an adhesive applicator is provided on the second conveying section of the conveying track, in the conveying direction upstream of the delivery location for the wire-stitched printed product, to apply an adhesive to the outside folded edge of the protective signature, so that the conveying movement of the protective signature can be used for applying the adhesive.

A signature feeder, for example a fold feeder, is advantageously installed upstream of the adhesive applicator.

The intermediate conveyor is preferably designed as a timed transporter with grippers attached to an endless traction mechanism at specific intervals. The grippers can be controlled to open and close.

Optionally, a transporter connects the removal station on the first conveying section of the conveying track with the delivery location on the second conveying section, thus resulting in a simple design.

In another exemplary embodiment of the invention, the intermediate conveyor has an ascending section, positioned downstream to the removal region of the first conveying section of the conveying track where the wire-stitched printed product is picked up, and a descending section, oriented in the direction toward a delivery region of the intermediate conveyor.

The delivery region of the intermediate conveyor follows the descending section of the intermediate conveyor, and the delivery region extends approximately in parallel to the delivery region of the second conveying section.

The use of a torque-controlled motor has proven particularly advantageous for the intermediate conveyor and the second conveying section of the conveying track.

In another exemplary embodiment, the protective signature advantageously takes the form of a poster or insert that can be removed from the printed product without leaving markings.

BRIEF DESCRIPTION OF THE DRAWING

The invention is explained in the following with the aid of an exemplary embodiment and by referring to the single figure of the drawing, wherein details not expressly mentioned in the specification may be discerned.

DETAILED DESCRIPTION OF THE INVENTION

Figure 1:
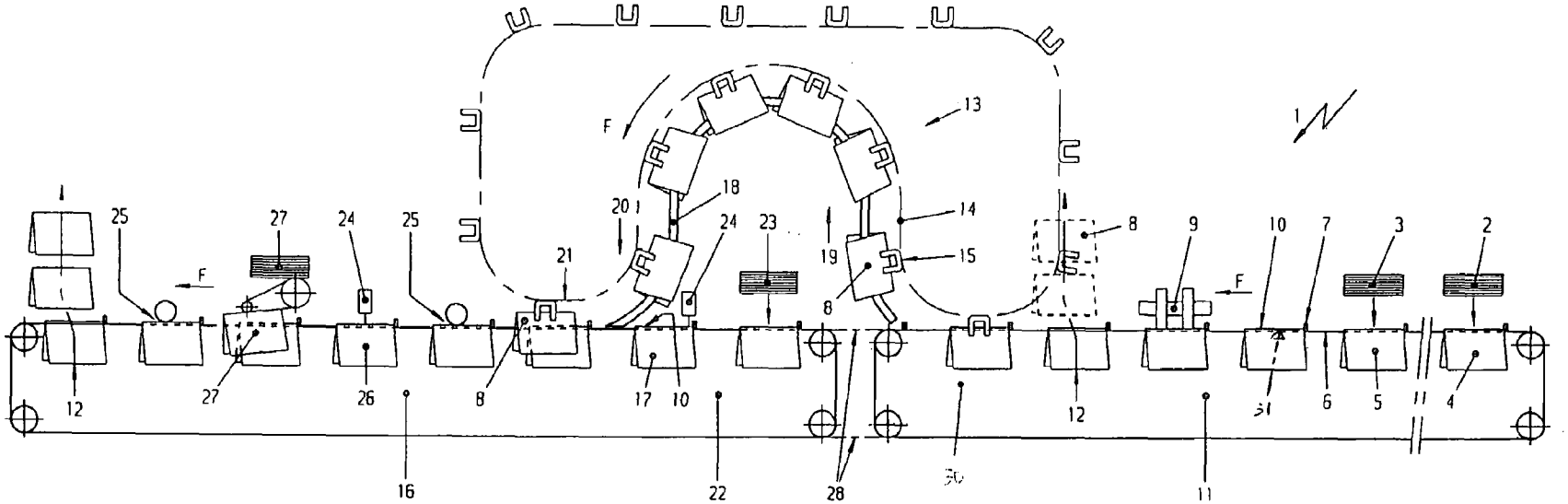
FIG. 1 shows a process diagram according to the invention.

The FIG. 1 shows an arrangement for producing a print article, comprising a printed product that is wire-stitched along the outside folded edge toward the inside folded edge, wherein the arrow F indicates the processing direction.

The process starts with a gathering and wire-stitching machine 1 which is provided with feeders 2, 3 along a first conveying section 11 of a conveying track. The feeders drop signatures 4, 5 onto an endlessly circulating gathering chain 6 in the manner that that the signatures 4, 5 straddle the gathering chain 6. The gathering chain 6 is provided with cogs 7 attached at regular intervals to push the collected signatures 4, 5 which are in the form of printed products 8 into a wire-stitching station 9. At the wire-stitching station 9, the printed products 8 are wire-stitched along an outside folded edge 10 with the wire sections pointing toward an inside folded edge 31 of the printed product 8. The first conveying section 11 can also be operated as the traditional gathering and wire-stitching machine 1, provided with a delivery station 12 where the wire-stitched printed products 8 are lifted off the gathering chain 6. Delivery stations are used for the removal of printed products 8, even at the gathering chain, for example, by lifting up a printed product and gripping the latter in the fold region.

In the exemplary embodiment of the invention, the wire-stitched printed products 8 are picked up at the removal region 30 located at the conveying end of the first conveying section 11 by an intermediate conveyor 13. This intermediate conveyor 13 may be a timed transporter provided, for example, at regular intervals with grippers or clamps 15 which open and close and are attached to an endlessly circulating traction mechanism 14. Grippers 15 grip the wire-stitched printed product 8 after it is first lifted off the gathering chain 6 at the removal region 30 and transport it in the direction of arrow F' to an additional or second conveying section 16. The additional conveying section 16, in turn, is again provided with a saddle-shaped support for depositing the wire-stitched printed product 8 once it has reached the depositing position where a previously supplied protective signature 17 is already waiting to be combined with the printed product 8. The printed product 8 that is taken over from the first conveying section 11 can be transported further in the opened state on a guide 18 to the additional conveying section 16 or can be re-opened before reaching the additional conveying section 16 with an opening device (not shown herein). Following the removal region of printed products 8, the intermediate conveyor 13 is provided with an ascending section 19 following the first conveying section 11, as well as a descending section 20 in the direction toward the delivery region for the printed product 8.

A delivery region 21 that extends approximately parallel to the additional conveying section 16 follows the descending section 20 of the intermediate conveyor 13. The grippers 15 are opened and closed mechanically or electro-mechanically, in a manner known per se.

A protective signature 17 is supplied in the conveying direction in an extension region 22 that is located upstream of the additional conveying section 16. The design according to the FIG. 1 provides a (known) feeder and/or fold feeder 23 for this, which feeds protective signatures 17 to the extension region 22. The protective signatures in the opened state are moved past an adhesive applicator 24 which applies adhesive to an outside folded edge 10 of the signatures 17 before they reach the delivery region where the printed products 8 are subsequently deposited on the protective signatures 17.

In one exemplary embodiment, the printed product 8 is pressed in a pressing station 25 onto the protective signature 17 while on the saddle-shaped conveying section.

Further downstream along the additional conveying section 16 of the conveying track, the outside folded edge of the combined article 26 can also be provided with adhesive and can be covered with a cover sheet 27.

Similar to the first conveying section, the second conveying section 16 could also be designed as a separate gathering and wire-stitching machine and both these sections could be used in tandem.

In another exemplary embodiment, the conveying sections 11 and 16 can also be connected by a continuous gathering chain 28 to give a simple design.

The invention has been described in detail with exemplary embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. An apparatus for producing a print article comprising at least one printed product wire-stitched along an outside folded edge with pre-formed wire sections pointing toward an inside folded edge, said apparatus comprising:

a first conveying section of a conveying track having:

a saddle-shaped support for conveying the printed product, said printed product straddling the saddle-shaped support; and a wire-stitching section for wire-stitching the printed product;

a second conveying section of the conveying track having a saddle-shaped support conveying a protective signature;

a feeder to feed the protective signature onto an extension region of the second conveying section;

an endless intermediate conveyor positioned near the end of the first conveying section and in alignment with the second conveying section, the intermediate conveyor picking up the printed product from the first conveying section in a removal region of the first conveying section and transporting and depositing the printed product in an opened state onto the protective signature conveyed by the second conveying section;

wherein the removal region of the first conveying section of the conveying track is operationally connected to a delivery region of the second conveying section where the printed product is deposited to the second conveying section from the intermediate conveyor, and pg,15 wherein the intermediate conveyor includes:

an ascending section positioned downstream from the removal region of the first conveying section; and a descending section oriented in a direction toward the delivery region; and an adhesive applicator positioned in the extension region of the second conveying section of the conveying track, upstream in a conveying direction of a delivery region where the printed product is deposited to the second conveying section from the intermediate conveyor, wherein the adhesive applicator is operative to apply an adhesive to an outside folded edge of the protective signature; and wherein the feeder is positioned upstream of the adhesive applicator.

2. The apparatus according to claim 1, wherein the feeder is a fold feeder.

3. The apparatus according to claim 1, wherein the intermediate conveyor further comprises an endless traction mechanism and grippers attached to the endless traction mechanism at regular intervals; to, wherein the intermediate conveyor is a time-controlled transporter and the grippers are controllable grippers having opened and closed positions. pg,16

4. The apparatus according to claim 1, wherein the delivery region of the intermediate conveyor follows the descending section of the intermediate conveyor, and wherein the delivery region of the intermediate conveyor extends approximately in parallel to the delivery region of the second conveying section.

5. The apparatus according to claim 1, wherein at least the intermediate conveyor and the second conveying section of the conveying track are driven by a torque-controlled motor.

6. The method according to claim 1, wherein the protective signature comprises a poster.

* * * * *